US008511476B2

(12) United States Patent
Cassani

(10) Patent No.: US 8,511,476 B2
(45) Date of Patent: Aug. 20, 2013

(54) DEVICE FOR SEPARATING PARTICLES OF DIFFERENT SYNTHETIC MATERIALS

(76) Inventor: Stefano Cassani, Imola (IT)

( * ) Notice: Subject to any disclaimer, the term of this patent is extended or adjusted under 35 U.S.C. 154(b) by 0 days.

(21) Appl. No.: 13/812,216

(22) PCT Filed: Jul. 14, 2011

(86) PCT No.: PCT/IB2011/001653

§ 371 (c)(1),
(2), (4) Date: Mar. 7, 2013

(87) PCT Pub. No.: WO2012/014031

PCT Pub. Date: Feb. 2, 2012

(65) Prior Publication Data

US 2013/0153471 A1 Jun. 20, 2013

(30) Foreign Application Priority Data

Jul. 29, 2010 (IT) ..... RE2010A0061

(51) Int. Cl.
*B07B 1/22* (2006.01)

(52) U.S. Cl.
USPC ..... 209/288; 209/270; 209/284; 209/293; 209/297

(58) Field of Classification Search
USPC ..... 209/17, 270, 284, 288, 293, 294, 209/297, 298
See application file for complete search history.

(56) References Cited

U.S. PATENT DOCUMENTS

| | | | | |
|---|---|---|---|---|
| 2,047,202 | A * | 7/1936 | Hardinge et al. | 209/452 |
| 4,043,901 | A * | 8/1977 | Gauld | 209/10 |
| 4,202,773 | A * | 5/1980 | Fink et al. | 210/256 |
| 4,252,642 | A * | 2/1981 | Mohri | 209/452 |
| 4,439,320 | A * | 3/1984 | Blok | 210/394 |
| 4,543,180 | A * | 9/1985 | Riker | 209/44 |
| 4,549,660 | A * | 10/1985 | Werling | 209/44.3 |
| 4,585,551 | A * | 4/1986 | Musselmann et al. | 209/379 |
| 5,524,769 | A * | 6/1996 | Spencer | 209/270 |
| 7,044,307 | B2 * | 5/2006 | Kamo et al. | 210/391 |
| 2009/0301939 | A1 * | 12/2009 | Sorensen | 209/44.3 |

FOREIGN PATENT DOCUMENTS

| | | | |
|---|---|---|---|
| DE | 4222119 | A1 | 1/1994 |
| JP | 58043252 | A | 3/1983 |
| JP | 10043626 | A | 2/1998 |
| JP | 2002254430 | A | 9/2002 |

OTHER PUBLICATIONS

Stelter, P. "Simulation of the liquid Throughput of a Twin-Cone Plastics Sorting Centrifuge" Aufbereitungs-Technik—Mineral Processing, Bauverlag BV GmbH, DE, vol. 43, No. 6, Jun. 6, 2002.

* cited by examiner

*Primary Examiner* — Joseph C Rodriguez
(74) *Attorney, Agent, or Firm* — Volpe and Koenig, P.C.

(57) ABSTRACT

An apparatus for separating synthetic materials having different characteristics includes a rotating drum having a cylindrical shape with a tapered end and an opposite flat bottom wall; a device configured to introduce a mixture of at least two synthetic materials in particle form and a liquid having an intermediate specific weight relative to specific weights of the two products into the drum; a radial discharge opening in the tapered end of the drum; an axial slithering discharge opening located in the bottom surface of the drum, at a distance from the drum axis, a rotor located inside the drum having a first external helical blade with the same external shape as the drum, a device configured to set the rotor in rotation relative to the drum. The blade is located at a distance from the rotor axis greater than the distance between the drum axis and the axial discharge opening.

5 Claims, 5 Drawing Sheets

DEVICE FOR SEPARATING PARTICLES OF DIFFERENT SYNTHETIC MATERIALS

TECHNICAL FIELD

The present invention relates to separation of particles of synthetic material of a determined quality from particles of synthetic materials of a different quality, with the aim of recuperating synthetic-material articles in undifferentiated collection thereof, finalised to re-use of the relative materials.

BACKGROUND ART

In the prior art this recuperation is done by first mincing the articles constituted by different materials with the aim of obtaining a granulate having a mean dimension of in the order of 0.5 to 25 mm.

The granulate comprises a mass made up of granules of different materials which in order to be re-used must be separated such as to obtain homogeneous masses comprising granules of the same material.

Separation methods are known which are based on the application of the tribo-electric effect, which do not always produce satisfactory results and involve the use of sophisticated plants which are expensive and difficult to run.

The prior art comprises plants equipped with a sedimentation tank in which the separation of plastic products is done by simple gravitational effect: the materials having a lower density with respect to the density of the liquid remain floating, while the materials having a heavier density that that of the liquid precipitate to the bottom of the tank.

DISCLOSURE OF THE INVENTION

The present invention proposes to perform the separation of various synthetic materials according to their specific weight.

In particular the invention proposes separating at least two materials having different specific weights.

The aim is attained by immersing the two materials in a liquid having an intermediate specific weight between the two, and by exploiting the different floating capabilities of the materials.

Further, the invention attains the result by subjecting the liquid and the materials together to a field having forces that are above the gravitational field, for example by exploiting centrifugal force, such as to significantly emphasise the difference in floatability of the materials in the liquid.

The method of the invention comprises at least the following activities:

- preparing a mixture of the two products to be separated in a liquid having an intermediate specific weight to the specific weights of the two products;
- introducing the mixture into a container,
- subjecting the mixture to a field having a greater force than a gravitational force;
- collecting the lighter granular product, floating on the surface of the liquid, by means of a hole in a wall of the container;
- collecting the heavier granular product, which remains resting on the wall of the container, from the container.

Obviously the method of the invention enables separation of a granular material having a smaller specific weight from a group of granular materials having a greater specific weight by using a liquid having a specific weight which is greater than the specific weight of the lighter material and lower than the specific weight of the other materials. Two groups of materials can also be separated from one another by using a liquid having a specific weight which is intermediate to the specific weights of the two groups.

An apparatus of the invention comprises a drum having differentiated circular sections into which a liquid of a known specific weight is introduced, and at least two synthetic materials in granular form having specific weights which are respectively greater and lower than that of the liquid. The external diameter of the drum is in the order of five hundred millimeters, and is preferably comprised between 200 and 1000 mm.

The shape of the drum is substantially truncoconical, with at least one cylindrical terminal tract in correspondence of larger-section bottom.

Means are provided for setting the drum in rotation.

A cylindrical terminal tract is also preferably provided in correspondence of the smaller-section bottom.

The axial length of the larger-section cylindrical tract is comprised between 0.4 and 0.7 times the length of the drum, and is preferably 0.66 times.

An axial conduit is provided for introduction of the liquid having known specific weight into the drum, and of the two granular materials to be separated.

The centrifugal force originating from the rotating motion of the drum is such that the liquid becomes arranged adjacent to the wall of the drum in the form of a constant-thickness liquid layer.

The thickness of the liquid layer is determined by a discharge light for the liquid, afforded in the greater bottom wall of the drum at an appropriate distance from the drum axis, such as to keep dry a smaller-section terminal tract of the drum.

The distance from the axis of the discharge light is adjustable preferably between d1 and d2, wherein d1 is smaller than d2.

As an example the discharge light can be implemented as a radial developed window afforded in the larger-section bottom of the drum, closed by a shutter adjustable in radial direction.

The truncoconical shape of the drum is such that the free surface never reaches the wall of the drum in the most tapered portion thereof.

The granules of material, according to their specific weight, are arranged either adjacent to the wall of the drum or at the free surface of the liquid.

In particular, the material that is heavier than the liquid is arranged adjacent to the wall of the drum, and the material that is lighter than the liquid is arranged at the free surface of the liquid.

The liquid is selected from among the following: pure water (distilled), with a specific weight of 1; water with additional elements entering in solution and increasing the specific weight thereof, such as salts, sugar, carbonates, sulphates, etc., with a specific weight of between 1 and 3; water added-to with elements which reduce the density thereof, such as alcohols, emulsion oils, additives facilitating dissolving of air in the water, etc, with a specific weight comprised between 0.5 and 1.

In general, liquids are chosen which have densities comprised between 0.5 and 3 and which do not alter the plastic materials.

At least an Archimedes screw is located adjacent to the wall of the drum, which is moved in rotation with respect to the wall of the drum, in the same direction of rotation as the direction of rotation of the drum The drum and screw are rotated at slightly different speeds, with the speed of the drum being of in the order of three thousand revolutions per minute, preferably comprised between 1000 and 10000 rpm, the relative speed of the screw with respect to the drum being of in the order of ten rpm, preferably comprised between 3 and 100 rpm.

The action of the screw is such as to push the particles of the heavier material, which have a greater specific weight than that of the liquid, and which are arranged against the wall of the drum, towards a radial discharge hole afforded on the dry tract of the drum wall in a proximity of the smaller-section bottom of the drum.

The particles that are lighter than the liquid, which float on the free surface of the liquid, exit the drum by encountering, together with the liquid through the discharge light provided on the larger-section bottom of the drum.

In a preferred embodiment of the invention, a second screw is provided, solidly constrained to and internal of the first screw and wound in an opposite direction thereto, having the task of pushing the light material floating on the surface of the liquid towards the axis discharge light provided in the larger bottom wall of the drum.

BRIEF DESCRIPTION OF DRAWINGS

The advantages and constructional and functional characteristics of the invention will more fully emerge from the detailed description that follows, with reference to the figures of the accompanying drawings which illustrate preferred embodiments thereof, given by way of non-limiting example.

BEST MODE FOR CARRYING OUT THE INVENTION

Figure 1:
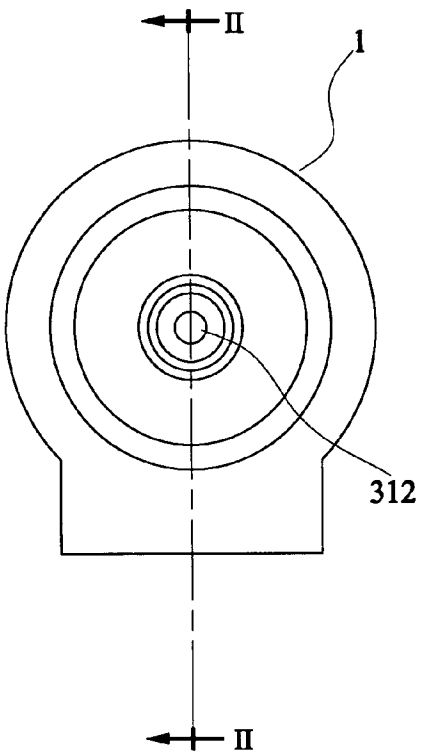
FIG. 1 illustrates a first embodiment of the invention in a frontal view.
Figure 3:
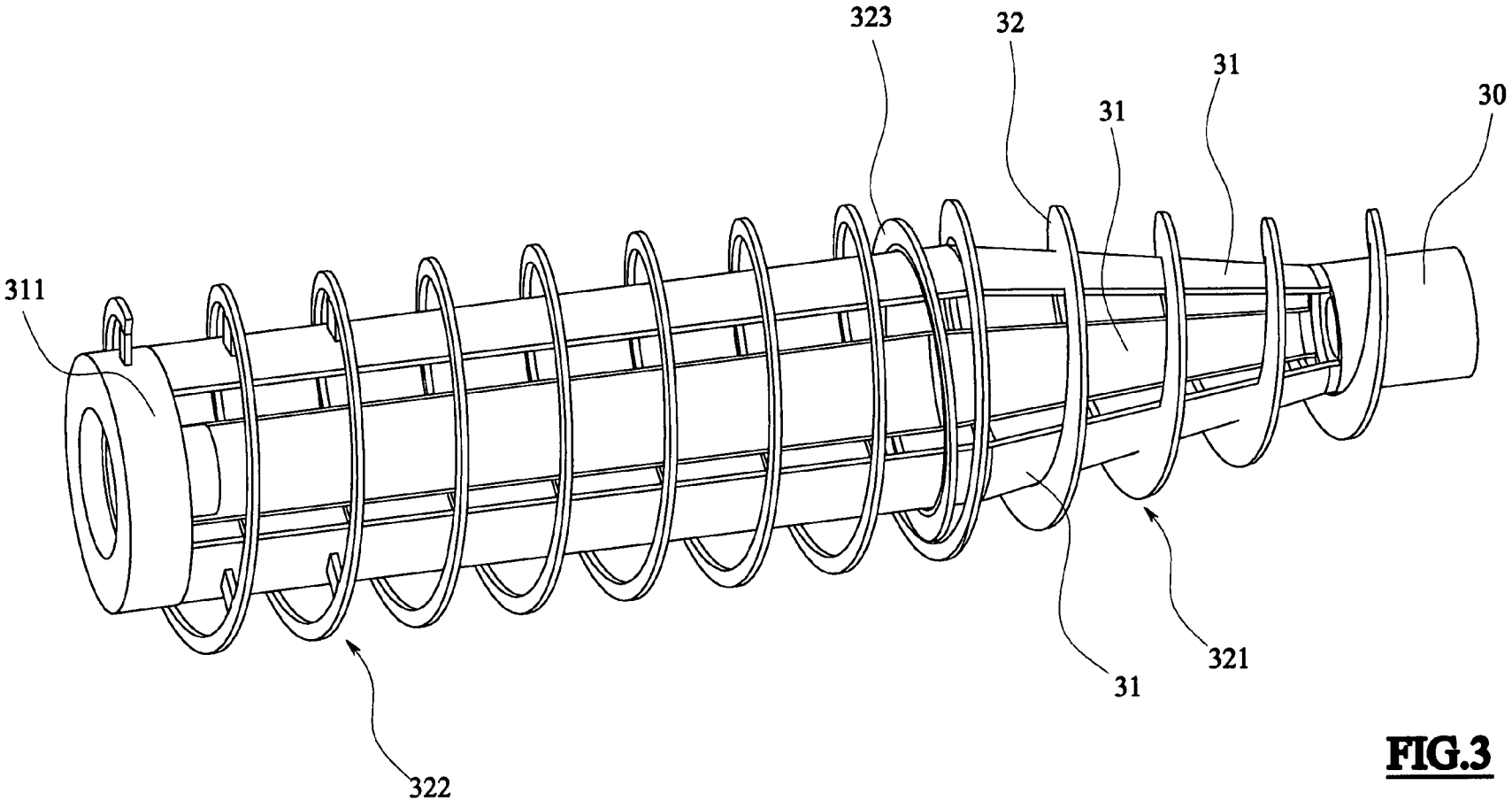
FIG. 3 is a perspective view of the rotor of FIG. 1.

FIGS. 1 and 3 illustrate a casing 1 resting on the ground.

A drum 2 is supported rotatingly internally of the casing 1, which drum 2 has a truncoconical central portion 21, and two end portions, respectively 22 and 23, which are cylindrical.

The end portion 22 having a larger section is closed by a cover 221 in which a hub 22 is afforded for rotating supporting the drum 2 to the casing 1.

The end portion 23 exhibiting the smaller section comprises an axial tract 231 in which a bearing 232 is located for rotatable support of the drum 2 of the casing 1, and a bearing 233 for supporting the end of an internal rotor 3.

The tract 231 bears a pulley 234 for activating the drum 2.

The internal rotor 3 is composed of a cage comprising a cylindrical portion 30 from which leave three equidistanced supports 31 on which an external first helical Archimedes screw 32 is wound, which follows the profile of the drum 2, very close to the wall thereof.

The first screw 32 has a conical portion 321 and a cylindrical portion 322.

The conical portion 321 ends with a small cylindrical tract encountering the wall of the smaller-section cylindrical tract of the drum.

The radial dimension of the helical blade of the first screw preferably increases progressively from the end having the larger section towards the end having the smaller section.

At the separating surface between the conical section and the cylindrical portion of the screw there is a separator wall 323 having a ring-shape, the external diameter of which is equal to the internal diameter of the first screw.

At the end of the cage having the larger section, the supports 31 of the first screw 32 are connected to a circular bottom wall 311 which is rotatably supported by the drum which is in turn supported by the casing 1 and bears an axial shaft 312 fixed thereto which terminates externally of the casing 1 and bears an activating pulley 313 of the rotor 3.

An axial conduit 24 is fixed internally of the tract 231, which axial conduit 24 extends internally of the rotor 3 up to reaching the cylindrical portion.

The cylindrical portion 23 of the drum 2 exhibits at least a radial hole 5 which opens internally of an end chamber 11 of the casing 1, for the exit of the heavier granulate.

The cover 221 of the larger end of the drum 2 exhibits at least an axial discharge light 6 from which the light particles exit, together with the liquid.

The light 6 opens into a chamber 12 of the casing communicating with the outside.

The light 6 has the shape of a radial window closed by a shutter 61 whose position is adjustable in radial direction by a screw 62.

Figure 4:
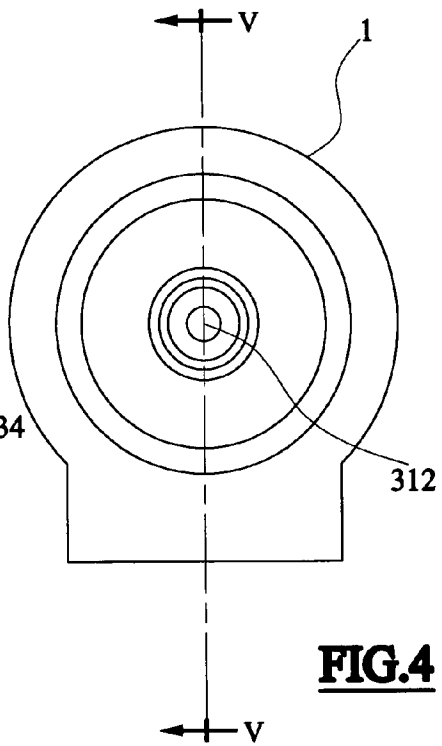
FIG. 4 is a second embodiment of the invention in a frontal view.
Figure 5:
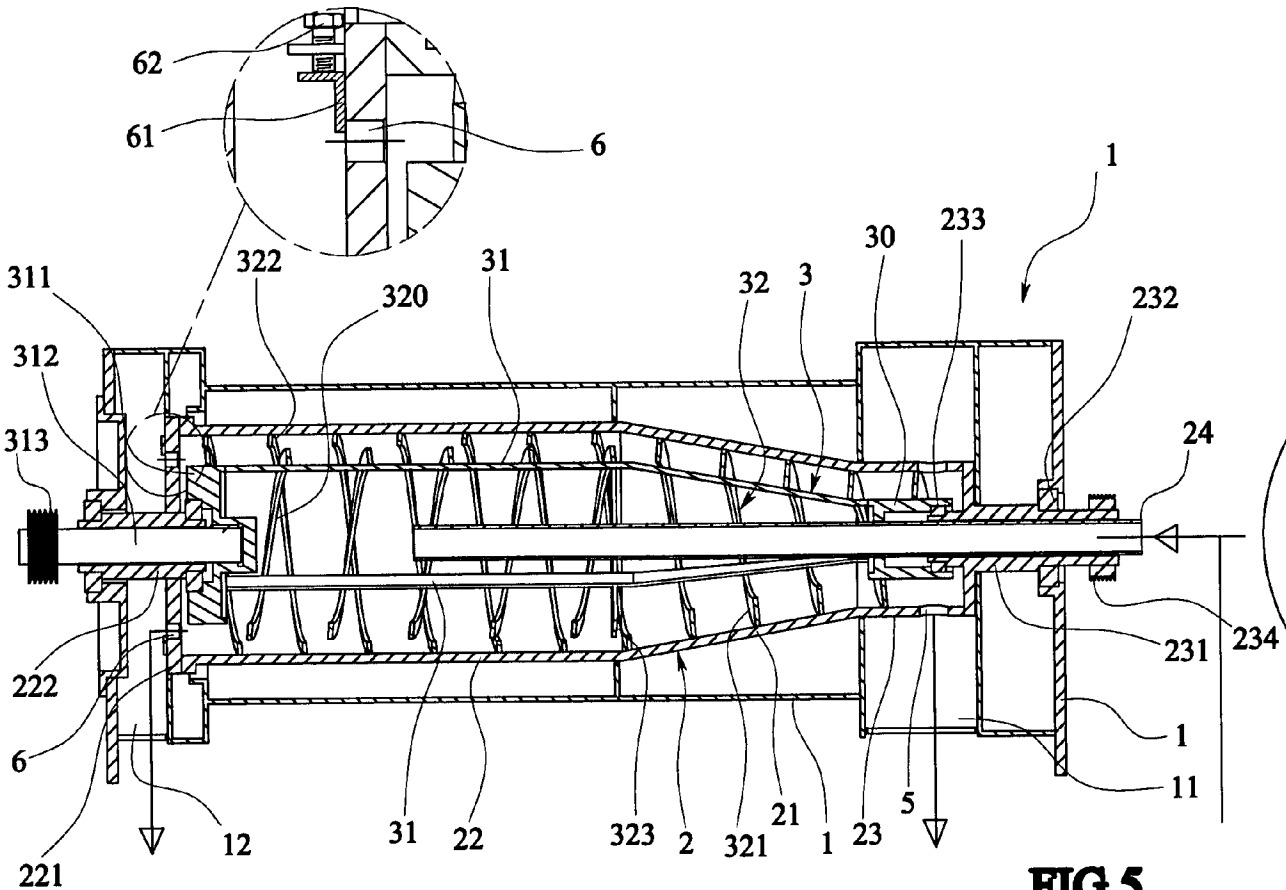
FIG. 5 is section V-V of FIG. 4.
Figure 6:
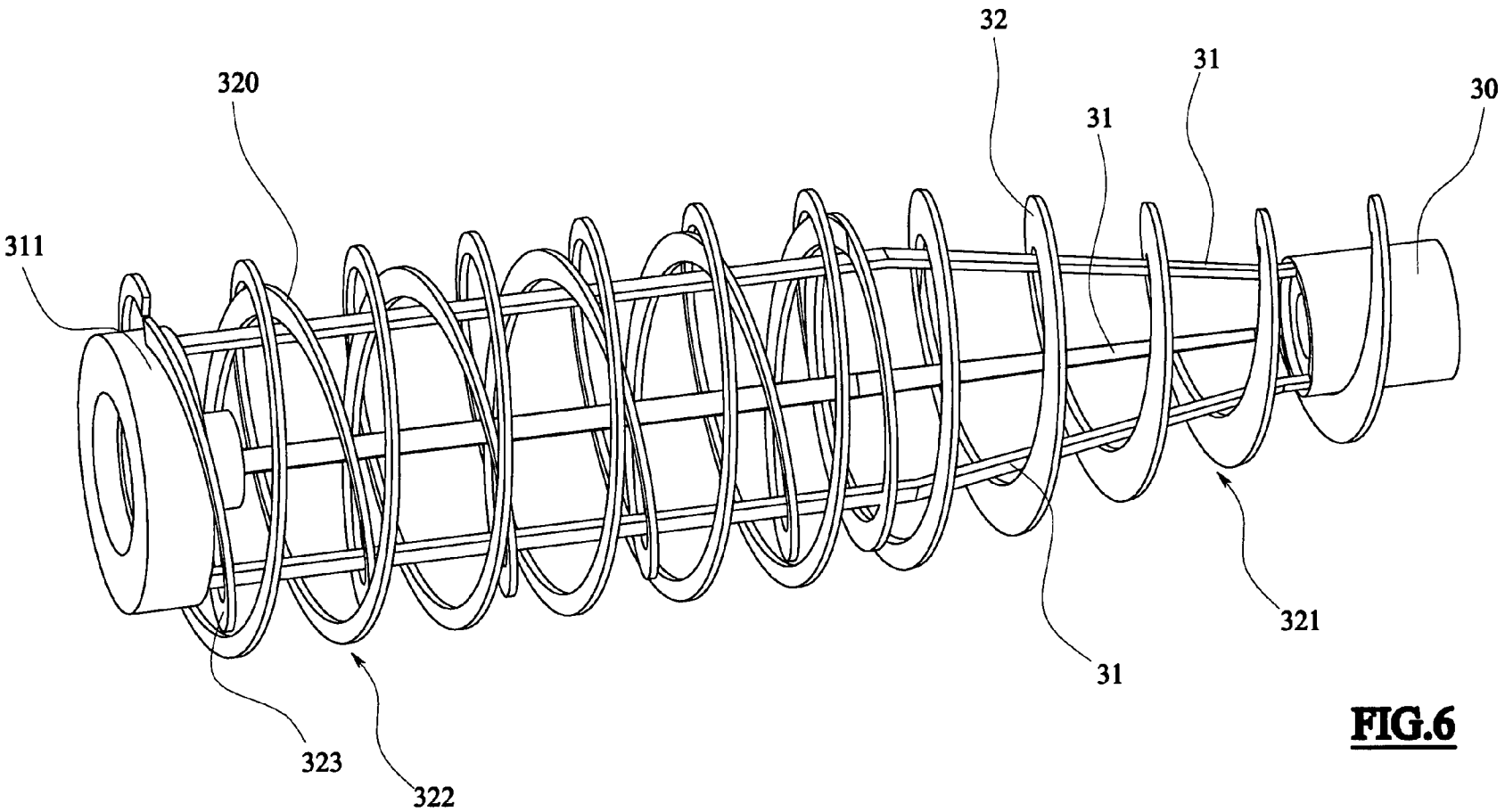
FIG. 6 is a perspective view of the rotor of FIG. 4.

The second embodiment of the invention illustrated in FIGS. 4 to 6 differs from the first embodiment due to the presence of a further screw located coaxially and internally of the screw of the first embodiment, and wound in an opposite direction thereto.

The task of the second screw is to act on the lighter material situated on the surface of the liquid in order to push the said material towards the exit hole. FIGS. 4 to 6 use the same numerical references as FIGS. 1 to 3, to denote the same elements illustrated in FIGS. 4 to 6.

The second screw is denoted by number 320 and is supported to the first screw 32 by welding the helical blade in the cross points of the helical blade with the first screw 32.

The external diameter of the second screw is constant and equal to the external diameter of the separator wall 323 on which it leans.

The axial extension of the second screw 320 is limited to the larger-section terminal cylindrical tract of the drum.

Figure 7:
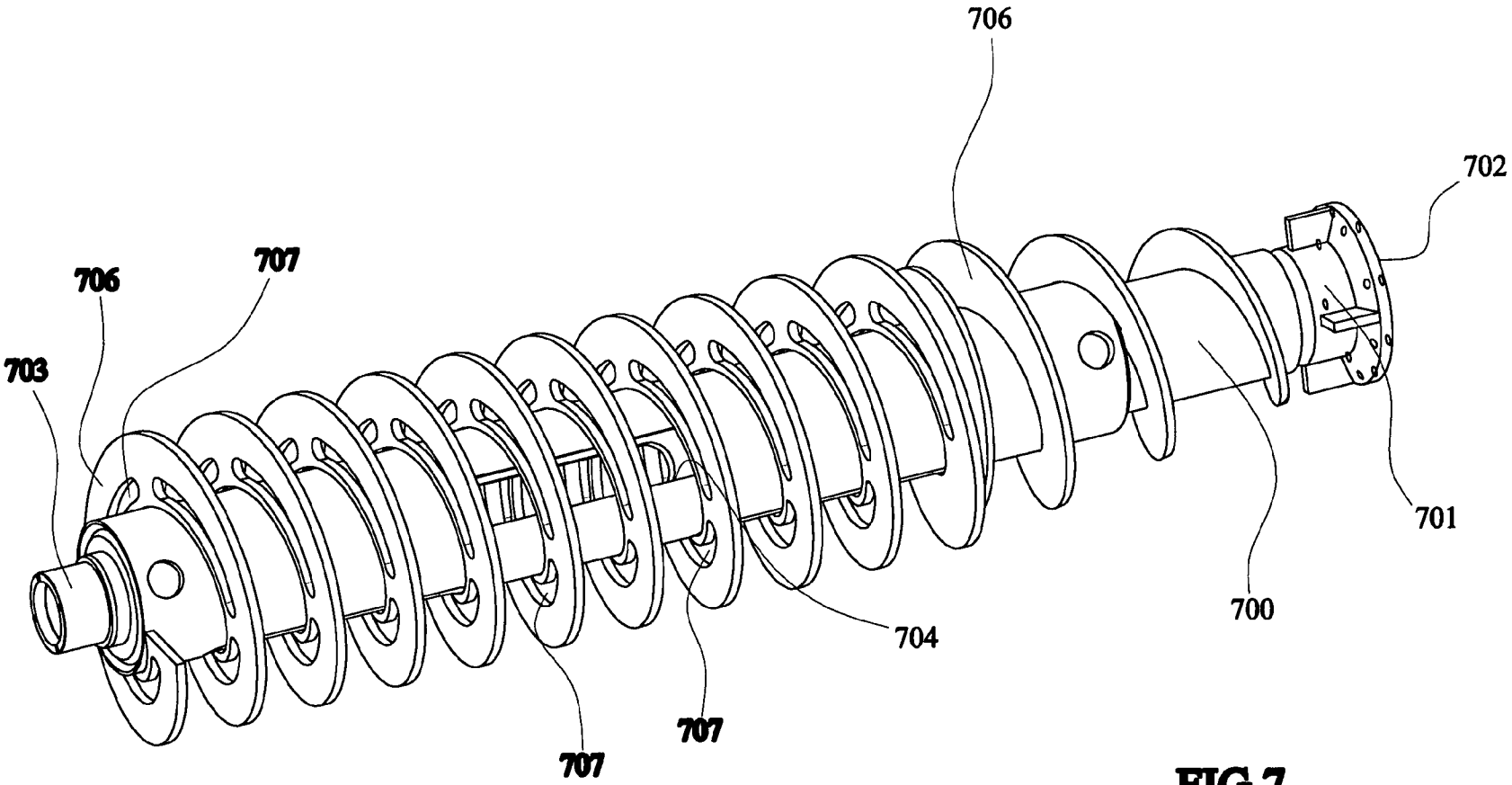
FIG. 7 is a perspective view of an alternative rotor to that of FIG. 3.

FIG. 7 represents an alternative rotor to that represented in FIG. 3.

The rotor comprises a hollow central shaft 700 ending on one end with a cylindrical portion 701 provided with a flange 702, which portion acting as the cylindrical body 30 of FIG. 3.

At the opposite end the shaft ends with a tang 703 suitable to be swivel coupled to the flat bottom of the drum.

The hollow central shaft 700 also acts as intake conduit of the material into the drum, and is provided in its central area with at least one axial window 704, located in the central area and allowing the exit of the material from the drum.

A blade 706 is spirally wrapped around the central shaft, the blade 706 exhibits a cylindrical tract which extends from the tang 703 in a axial direction for a length equal to the drum axial length and ends with a conical tract in which the blade exhibits decreasing height so as to slither against the wall of the conical tract of the drum.

The blade portion of the cylindrical tract exhibits some circular-slot shaped windows or opening 707, aligned with the adjacent openings of the adjacent spiral turns, forming conduits allowing the downflow of the liquid layer, and the material granules floating thereof, towards the discharge light 6 provided in the larger-section bottom of the drum.

Figure 2:
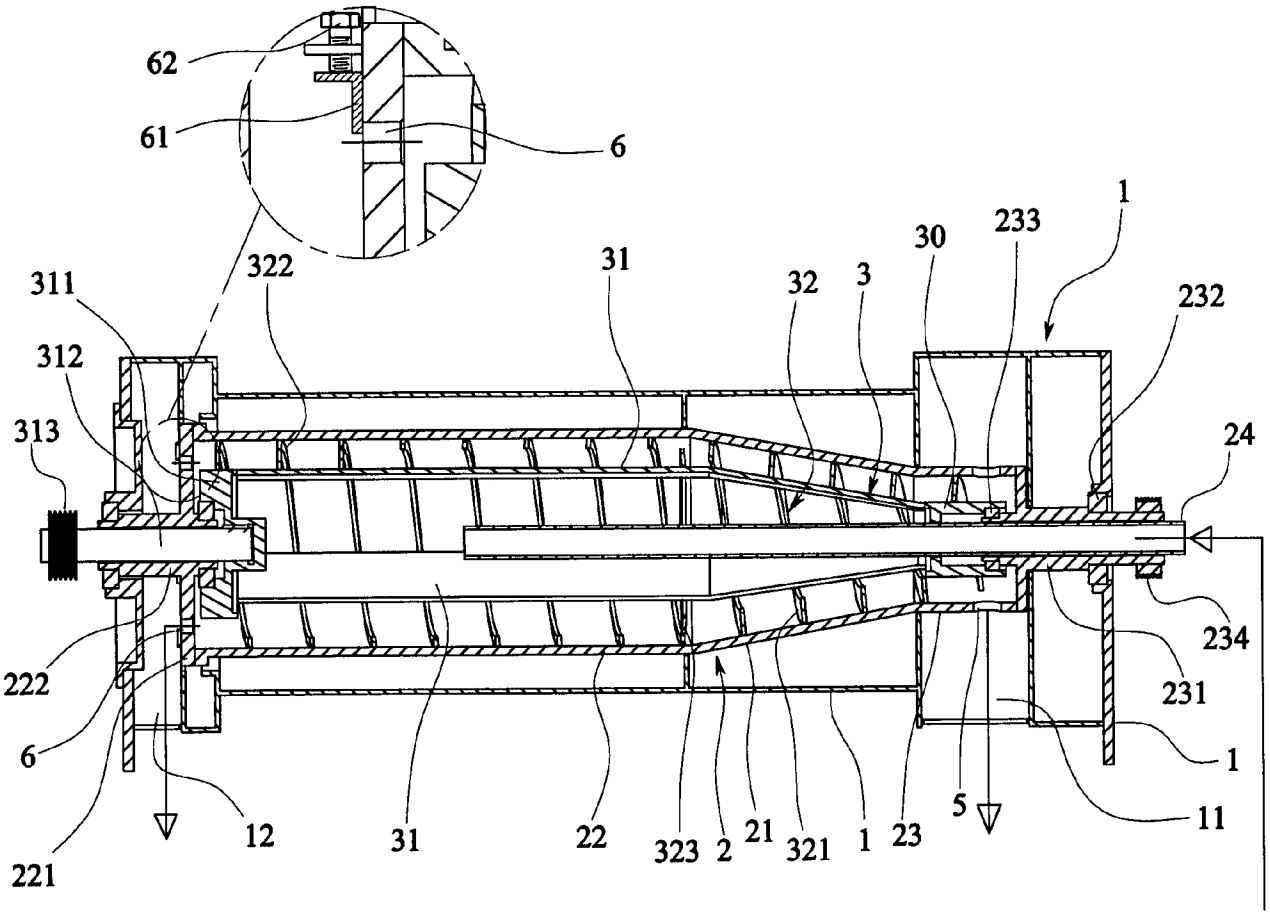
FIG. 2 is section II-II of FIG. 1.

The operation of the rotor in FIG. 7 is the same as the operation of the rotor in FIGS. 2 and 3.

The dimensions of the windows are such that the distance between their external edge and the axis of the tube 700 is greater than the maximum distance of the discharge light from the drum axis, in such a way that the portion of the blade external to the windows 700 is always submerged in the liquid, not engaging the portion of the liquid layer where the particles with lower specific weigh float.

The invention is not limited to the embodiments described herein above, and variants and improvements may be brought thereto without its forsaking the ambit of the following claims.

The invention claimed is:

1. An apparatus for separation of at least two synthetic materials in particulate form having different characteristics, the apparatus comprising:

a rotating drum (2) having a cylindrical shape with a tapered truncoconical end (21) and an opposite flat bottom wall (221);

a device (234) configured to set the drum in rotation;

a conduit (24) configured to introduce into the drum (2) a mixture composed of at least two synthetic materials in particle form, having different specific weights, and of a liquid, having an intermediate specific weight relative to the specific weights of the two products;

a radial discharge hole (5) located in the lateral wall of the tapered end of the drum;

an axial slithering discharge opening (6) located in the flat bottom surface (221) of the drum, at a distance d from the axis of the drum (2);

a rotor (3) located inside the drum (2) provided with a first external helical blade (32) having the same external shape as the drum (2) shape and having respective cylindrical (322) and tapered conical (321) portions;

a device (313) configured to set the rotor (3) in rotation relative to the drum (2), in such a way that the rotor pushes the material towards the tapered end of the drum; wherein the first external helical blade (32) extends along the entire length of the drum (2) and is located at a distance from the axis of the rotor and of the drum greater than the distance between the drum axis and the axial discharge opening provided in the non-tapered section drum bottom, wherein the rotor (3) comprises a second helical blade (320), inside the first helical blade (32) and wrapped at a distance from the drum axis in an opposite direction than that of the first helical blade (32), the second helical blade (320) extending for the entire length of a cylindrical tract (22) of the drum (2), and being supported to the first helical blade (32) at cross points with the first helical blade (32) to leave free the axial portion of the drum.

2. The apparatus according to claim 1 wherein the rotor (3) rotates in the same direction of rotation as the drum (2).

3. The apparatus according to claim 1 wherein the axial discharge opening (6) located on the non-tapered section bottom wall (221) of the drum (2) is at a distance from the axis of the drum which distance is greater than a minimum radius of the tapered section of the drum (2).

4. The apparatus according to claim 1 wherein a ring (323) is located between the cylindrical portion (322) and the conical portion (321) of the first helical blade (32) to separate said portions.

5. The apparatus according to claim 4 wherein the second helical blade (320) ends against the ring (323) separating the cylindrical portion (322) and the conical portion (321) of the first helical blade (32).

* * * * *